US010188583B2

(12) United States Patent
Ding et al.

(10) Patent No.: US 10,188,583 B2
(45) Date of Patent: Jan. 29, 2019

(54) PORT CONFIGURATIONS FOR A FLUIDS CONTAINER

(71) Applicants: BAXTER INTERNATIONAL INC., Deerfield, IL (US); BAXTER HEALTHCARE S.A., Glattpark (Opfikon) (CH)

(72) Inventors: Yuangpang Samuel Ding, Long Grove, IL (US); Steven C. Jepson, Vernon Hills, IL (US)

(73) Assignees: BAXTER INTERNATIONAL INC., Deerfield, IL (US); BAXTER HEALTHCARE S.A., Glattpark (Opfikon) (CH)

( * ) Notice: Subject to any disclaimer, the term of this patent is extended or adjusted under 35 U.S.C. 154(b) by 0 days.

(21) Appl. No.: 15/524,967

(22) PCT Filed: Nov. 6, 2015

(86) PCT No.: PCT/US2015/059544
§ 371 (c)(1),
(2) Date: May 5, 2017

(87) PCT Pub. No.: WO2016/073898
PCT Pub. Date: May 12, 2016

(65) Prior Publication Data

US 2017/0340517 A1 Nov. 30, 2017

Related U.S. Application Data

(60) Provisional application No. 62/076,548, filed on Nov. 7, 2014.

(51) Int. Cl.
*A61J 1/14* (2006.01)

(52) U.S. Cl.
CPC ..... *A61J 1/1475* (2013.01); *A61J 1/1431* (2015.05)

(58) Field of Classification Search
CPC ..... A61J 1/05–1/1487
(Continued)

(56) References Cited

U.S. PATENT DOCUMENTS 3,805,788 A * 4/1974 Kleiner ..... A61M 1/0001 215/309
3,840,153 A * 10/1974 Devlin ..... A45F 3/20 215/229
(Continued)

FOREIGN PATENT DOCUMENTS

| | | |
|---|---|---|
| EP | 0380934 | 8/1990 |
| EP | 0669123 | 8/1995 |
| EP | 1776942 | 4/2007 |

OTHER PUBLICATIONS

International Search Report, dated Jan. 19, 2016 for Appl. No. PCT/US2015/059544.

*Primary Examiner* — Kareen K Thomas
(74) *Attorney, Agent, or Firm* — Greer, Burns & Crain, Ltd.

(57) ABSTRACT

A container closure is provided for use in dispensing fluids from a container, and includes a base constructed and arranged for being attached to a mouth of the container, a first port disposed on the base and in fluid communication with the mouth, a second port disposed on the base in fluid communication with the mouth, and the first and second ports being visually differentiated from each other.

14 Claims, 10 Drawing Sheets

(58) Field of Classification Search
USPC ..... 220/601, 253; 215/DIG. 3, 247, 297
See application file for complete search history.

(56) References Cited

U.S. PATENT DOCUMENTS

| | | | | |
|---|---|---|---|---|
| 4,152,378 | A * | 5/1979 | Vcelka | A61J 1/05 261/121.1 |
| 4,951,845 | A | 8/1990 | Pezzoli et al. | |
| 5,314,406 | A * | 5/1994 | Arias | A61B 17/3203 604/167.04 |
| 5,520,677 | A | 5/1996 | Hansen | |
| 7,356,237 | B2 * | 4/2008 | Mullaney | G02B 6/4441 385/135 |
| 7,611,502 | B2 | 11/2009 | Daly | |
| 7,981,182 | B2 * | 7/2011 | Volchko | F02D 33/003 210/320 |
| 2003/0088232 | A1 | 5/2003 | Duell | |
| 2010/0081995 | A1 * | 4/2010 | Widenhouse | A61B 17/3462 604/164.08 |

* cited by examiner

PORT CONFIGURATIONS FOR A FLUIDS CONTAINER

CROSS-REFERENCES TO RELATED APPLICATIONS

This application is a national phase of International App. No. PCT/US2015/059544, filed on Nov. 6, 2015, which claims priority to U.S. patent application Ser. No. 62/076,548, filed on Nov. 7, 2014, the entirety of both of which are incorporated herein by reference.

BACKGROUND

The present invention relates generally to containers such as flexible bags, IV containers or the like for delivering medicinal fluids to patients, and more specifically to such containers having multiple ports, one such port, called an administration port used for delivering the primary fluid stored in the container, and a separate port, called a medication port used for introducing a desired additive, such as a medicine or medicinal ingredient, into the solution in the container. In certain situations, the medication port is also used to withdraw fluid (air or liquid) from the container.

Medical clinicians desire two distinct ports (medication and administration ports) for providing the range of infusion therapies common in current medical practice. Both ports are preferably rigid to allow safe, ergonomic handling and prevent injury or container damage when using needles or spikes on IV sets or other devices (including reconstitution devices called "recon"). Certain recon devices attach to the medication port, and others attach to the administration port. A growing use of automated admixture systems calls for rigid ports with adequate spacing for machine interface.

The medication ("med") and administration ("admin") ports are preferably independently accessible. In certain situations, the med port should be accessed while the admin port is "spiked" by an administration set. The following two scenarios provide examples of this situation:

Medication is added to the bag while it is already spiked, hanging, and infusing to the patient.

For cytotoxic/oncolytic medications, NIOSH guidelines require the pharmacy to spike the bag and prime the administration set before adding the medication to the bag. This procedure reduces risk of nurse exposure to the cytotoxic agent when connecting the primed IV set to the patient catheter or IV line.

It is preferred that clinicians are able to access each port individually, maintain aseptic technique, and avoid damaging or touch contamination of the other port. For example, the sterile cover on the admin port should not be disturbed or damaged when accessing the med port with an antiseptic wipe, spray, needle, or recon device. In another example, the clinician should be able to spike the admin port if a recon device is already attached to the med port.

It is desirable for each med and admin port to have a sufficiently large diameter, preferably in the range of 10 mm, that is considered adequate for providing target area to safely receive needles or IV spikes. If either the needle or the spike "misses" the target, container damage or clinician injury can occur. In addition, if the needle or spike is inserted through the target but at a certain angle, it may unintentionally strike the internal wall of the port lumen. Needles or spikes striking the port internal wall can generate PM, delay workflow/therapy, or produce a no-flow or disconnect condition. Also, clinicians take special care to avoid the needles and spikes coming in contact with each other during the medical administration process.

Many port designs include flanges or protrusions beyond the primary cylindrical protrusion to accommodate sterile covers, device attachment, provide finger protection during needle or spike use, prevent touch contamination during use, and provide improved ergonomic grip. These flanges or protrusions add to the need for port spacing.

It is desirable to reduce dead space between each port lumen and the container bulk contents to similarly reduce residual volume after gravity infusion and to also reduce the risk of pooling concentrated residual medication in or near the med port.

The container design should provide "access evidence" for both ports. If clinicians encounter an IV container that is missing a "cover" on either port for unknown reasons, they will typically discard the container because they cannot be certain that something has or has not been added to the container. Typical IV containers include a removable sterile cover on the admin port that provides "access evidence" as long as it cannot be easily re-attached and enables aseptic connection when connecting the spike on an IV infusion set or other device.

However, the majority of typical IV containers do not include a sterile cover on the med port. Therefore, clinicians should disinfect or "swab" the med port before access. However, these containers generally include an overpouch ("OP") that provides several functions, including barrier properties for shelf life. The OP provides the "access evidence" function for an un-covered med port. For IV containers that do not have an OP, including an access evident cover on the med port is highly desirable. The med port cover should also provide a sterile barrier so the clinician does not need to disinfect or swab the med port prior to the first access.

On subsequent med port accesses, the med port should be swabbed, which introduces a sterile cover requirement unique to the med port but not required for an admin port: med port design shall enable swabbing after sterile cover removal. Swabbing the admin port after sterile cover removal is not required because the admin port is accessed only once.

To prevent adding additional medication to an IV container after the pharmacist has admixed a patient-specific "dose", pharmacists often add a "post-admix cover" or "additive cap" to the med port after admixing, which indicates to other clinicians that med has been added and nothing else should be added to the container. Several "post-admix cover" designs are available, including foils and rigid molded components. Ideally, the "post-admix cover" is highly visible, not easily removable and is rigid to prevent needle access. Thus, any med port should accommodate attachment of a range of "post-admix covers" to accommodate current clinical practice. The "post-admix cover" does not need to provide a sterile barrier. The "post-admix cover" products represent a distinct component and inventory item purchased by the hospital pharmacy.

Ports are preferably manufacturable in high volumes at low cost, referred to as "design for manufacturability" or "DFM". Automated machine tooling and fixtures are typically used to handle, convey, and position the ports and insert/seal port components including internal septums, plugs, stoppers, or sleeves and external covers including heat sealed films, snap fit molded components, and welded components. DFM requirements add to the need for port spacing.

Based on the design criteria summarized above, the ports on conventional IV containers are typically spaced 1-2" (25-50 mm) apart. Current methods for making ISBM containers with a single open end limit the opening size to approximately an 18 mm i.d. circle with a 29 mm diameter flange. For the single-ended ISBM containers made using current methods, the 18 mm i.d. circular opening with 29 mm o.d. flange does not allow placement of two parallel ports with ~10 mm diameter with spacing adequate to avoid the needle or spike striking the inside wall of the 18 mm id opening. This dimensional limitation has provided a design challenge for port manufacturers.

SUMMARY

Accordingly, the present port design addresses the needs discussed above and the drawbacks of conventional medication port designs by providing two distinct ports that meet the all requirements listed above while hermetically connecting them to an 18 mm id opening on an ISBM container with 29 mm flange, and reducing the risk of the needle or spike striking the inside wall of the opening, or the needle and spike striking each other in situations where medication is added while a device spike is already inserted. In the present closures, the above goals are addressed by providing both med and admin ports for ISBM containers (with a single-opening having limited size) that are differentiated, easily distinguishable, and easily accessible without inadvertently contaminating or obstructing the other port. The ports should be visually distinguished and identifiable by function so it is clear to the end-user which port to use for the desired task. Another feature of the present port design is providing med port cover designs which provide a sterile barrier, access evidence, and ease of use. The present med port sterile cover is highly desirable for IV containers with no OP, and mildly desirable or "nice to have" for IV containers that have an OP, which provides the access evidence function for the med port.

More specifically, a container closure is provided for use in dispensing fluids from a container, and includes a base constructed and arranged for being attached to a mouth of the container, a first port disposed on the base and in fluid communication with the mouth, a second port disposed on the base in fluid communication with the mouth, and the first and second ports being visually differentiated from each other.

In another embodiment, a container closure is provided for use in dispensing fluids from a container, and includes a base constructed and arranged for being attached to a mouth of the container, a first port disposed on the base and in fluid communication with the mouth, a second port disposed on the base in fluid communication with the mouth, and the first and second ports being constructed and arranged on the base to have at least one of distinguishable height and a distinguishable angle relative each other.

DETAILED DESCRIPTION

Figure 1:
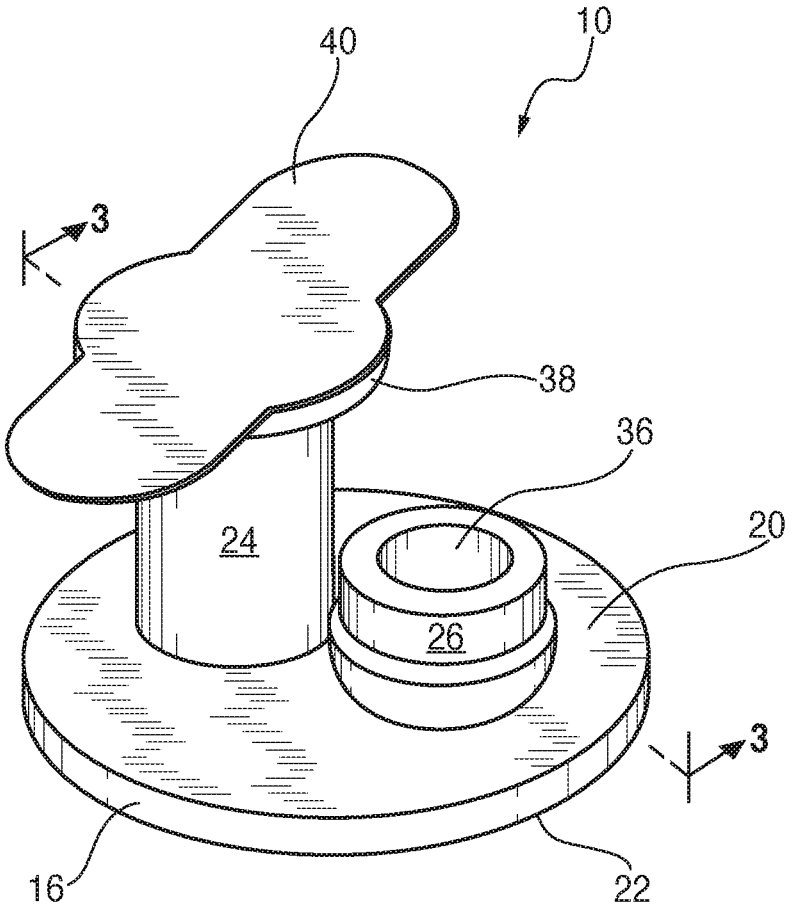
FIG. 1 is a top perspective view of the present container closure.
Figure 2:
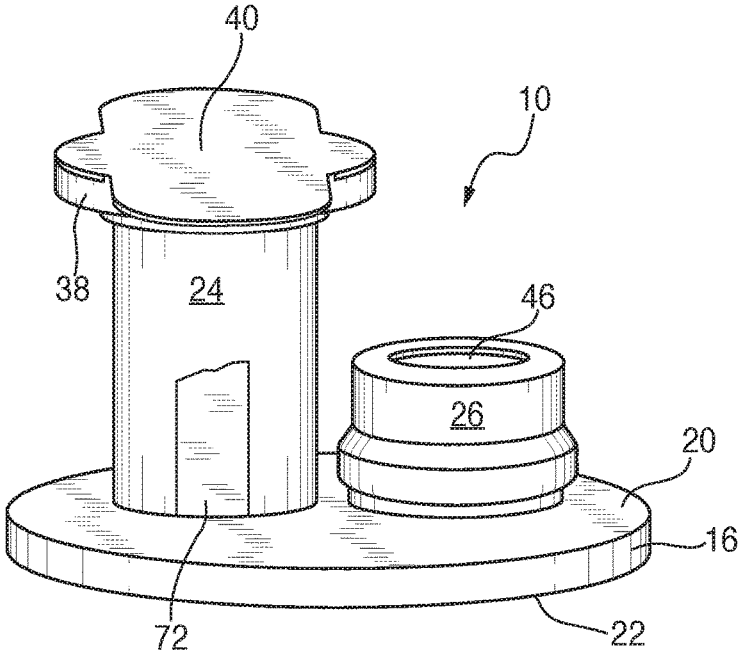
FIG. 2 is a side perspective view of the closure of FIG. 1.

Referring now to FIGS. 1 and 2, the present container closure is generally designated 10, and is constructed and arranged for operational attachment to a container 12 (FIGS. 3 and 6) having an open neck 14. Conventional attachment technologies include heat sealing, chemical adhesives, ultrasonic welding and the like. In the preferred embodiment, it is contemplated that the container 12 is a conventional medicinal fluids container for providing saline solutions, glucose solutions and other known fluids for dispensing to a patient, and incorporating additional medications as needed, as is well known in the art. Also well known is that the container 12 is either flexible or rigid, being in the form of a flexible bag or a molded, more rigid container.

Included on the closure 10 is a base 16 constructed and arranged for being attached to a mouth 18 at the end of the container neck 14. The base 16 is generally disk-shaped and substantially planar on an upper surface 20 and a lower surface 22. In the depicted embodiment, the base 16 is configured to be generally complementary to the dimensions of the mouth 18, however different dimensions and/or shapes of the base are contemplated.

A first port 24 is disposed on the base 16, is in fluid communication with the mouth 18, and projects in a direction from the base opposite from the container 12. In addition, a second port 26 is similarly disposed on the base 16, is in fluid communication with the mouth, and projects away from the container 12 as well. While in the present embodiment, the first port 24 is also referred to as an administration port, and the second port 26 is also referred to as a medication port, it is also contemplated that the roles of the ports 24, 26 may vary to suit the application.

An important feature of the present closure is that the first and second ports 24, 26 are configured for being visually differentiated from each other to facilitate clinician activity at either port so that substances, solutions, medicines, additives, etc. inserted or withdrawn using one port are maintained separate from the other port. Also, it should be noted that closure 10 is usually positioned at a lower end of the container 12, which is suspended in a patient's room or in a similar medical facility where fluids are dispensed to patients. Generally, the first (administration) port 24 is connected to a delivery tube (not shown) for dispensing fluid to the patient. The second (medication) port 26 is primarily used for introducing separate medicines or other solutions into the container 12 for mixing with the main fluid in the container and for eventual delivery to the patient.

Figure 3:
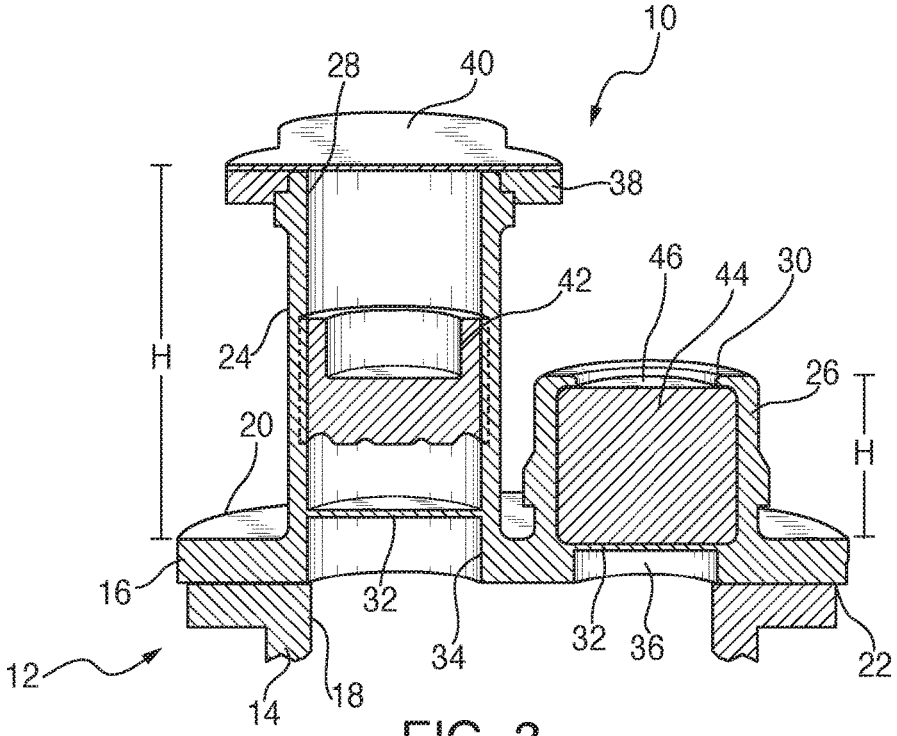
FIG. 3 is a vertical cross-section of the closure of FIG. 1 taken along the line 3-3 and in the direction indicated generally.

Referring now to FIGS. 1-3, it will be seen that, in addition to being visually differentiated, the ports 24, 26 are structurally distinguishable. As depicted, the first port 24 has an axial height "H" measured from the base 16 to an upper or outlet end 28. Similarly, the second port 26 has a height "h" measured from the base 16 to an upper or inlet end 30, such that "H" is greater than "h," and the first port 24 projects a greater distance than the second port. More preferably, "H" is at least twice as tall as "h". The difference in height is contemplated to vary with the situation. Preferably, the med port 26 is shorter than the admin port 24 to minimize residual concentrated medication pooling in the med port lumen.

At least one and preferably both of the ports 24, 26 have a frangible diaphragm 32 which seals respective internal passageways 34, 36 until pierced by a suitable needle, syringe, connector or other delivery device. Also, the outlet end 28 is provided with a laterally extending gripping flange 38 either integrally molded or otherwise attached to the port 24 for facilitating the clinician retaining the port while connecting it to a suitable tube for patient delivery. The outlet end 28 is maintained in antiseptic condition through the use of a peel film or sealing tape 40 secured in place using heat sealing or a suitable adhesive or the like. Similarly, a rigid component, molded or extruded, is contemplated as providing a sterile cover for the admin port.

A septum or sleeve 42 is secured within the internal passageway 34 and is shown as the self-sealing needle-stick type, while the septum forms a fluid-tight barrier in the passageway, when a needle or spike pierces the septum, fluid communication is created across the barrier. While the needle or spike is indwelling, the septum or sleeve 42 forms a hermetic seal around the needle or spike. Upon removal of the needle or spike, the septum 42 is made of a sufficiently resilient material that the barrier is resealed. Similarly, the second port 26 is provided with another variant of a needle-stick septum 44, in that it features a flat upper surface 46 which easily wiped with antiseptic by clinicians before insertion of a needle.

Figure 4:
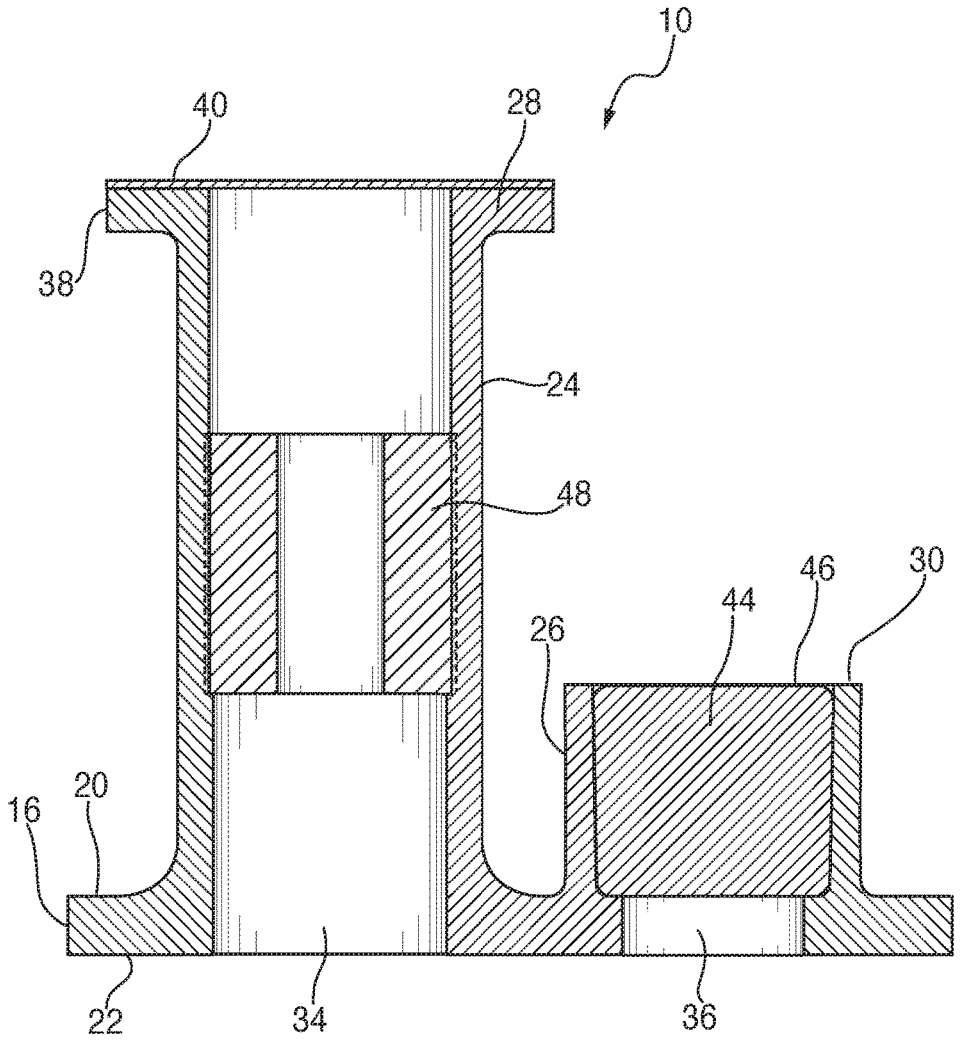
FIG. 4 is a vertical cross-section of an alternate embodiment of the closure of FIG. 1.

Referring now to FIG. 4, the closure 10 is shown with a sleeve-type septum 48 used for accommodating administration spikes (FIGS. 6-8) with the acknowledgment that upon removal of the spike, any remaining fluid in the container 12 will leak out. The sleeve 48 provides a hermetic seal around a range of plastic spike sizes; however, it will not provide a seal around an indwelling needle (because steel needles have smaller wall thickness and diameter than plastic spikes). Varieties of the sleeves or septums 42, 44, 48 are contemplated in various port configurations as are known in the art.

Figure 5:
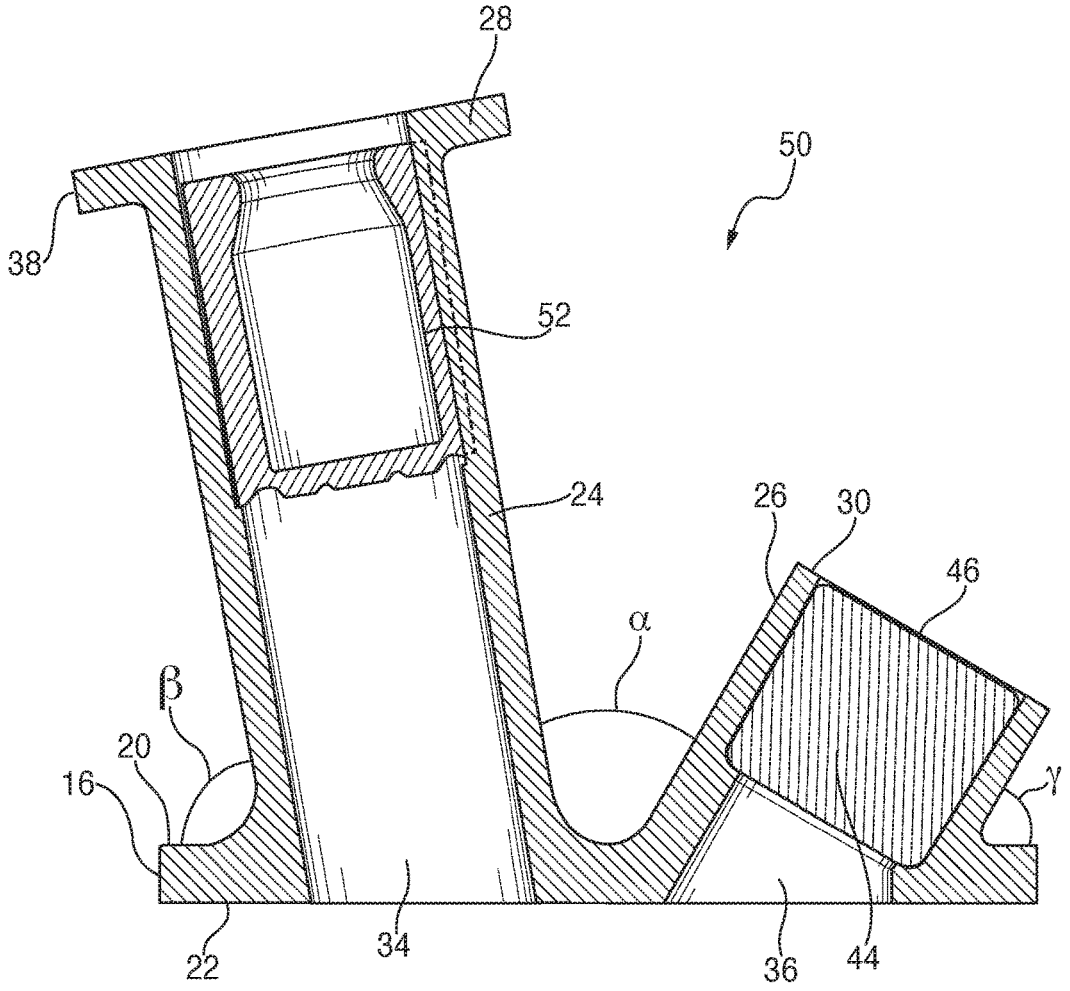
FIG. 5 is a vertical cross-section of still another alternate embodiment of the closure of FIG. 1.

Referring now to FIG. 5, an alternate embodiment of the present closure 10 is generally designated 50. Components shared with the closure 10 are designated with identical reference numbers. A main distinguishing feature of the closure 50 is that the first port 24 is disposed at a non-vertical or oblique angle $\alpha$ relative to the second port 26, and further that the first and second ports 24, 26 are each oriented at specified oblique angles $\beta$ and $\gamma$ relative to the upper base surface 22. In the preferred embodiment, the angles $\alpha$, $\beta$ and $\gamma$ are distinct from each other, however it is contemplated that they may vary to suit the application. The result of these angles is that the respective outlet end 28 and the inlet end 30 are further displaced from each other to reduce the chances for clinicians to mistakenly add medicine to the wrong port 24, 26, or to make unwanted contact between the respective ports, or to the spike or needle used for making fluid connections to the respective ports. Also, orienting the ports 24, 26 in this angular manner maintains the desired structural integrity of the base 12. Another distinguishing feature of the closure 50 is that the first port 24 includes a spike sleeve 52 secured in the passageway 34 near the outlet end 28, which is a known alternative to the sleeves, 42, 44, 48 discussed above.

Figure 6:
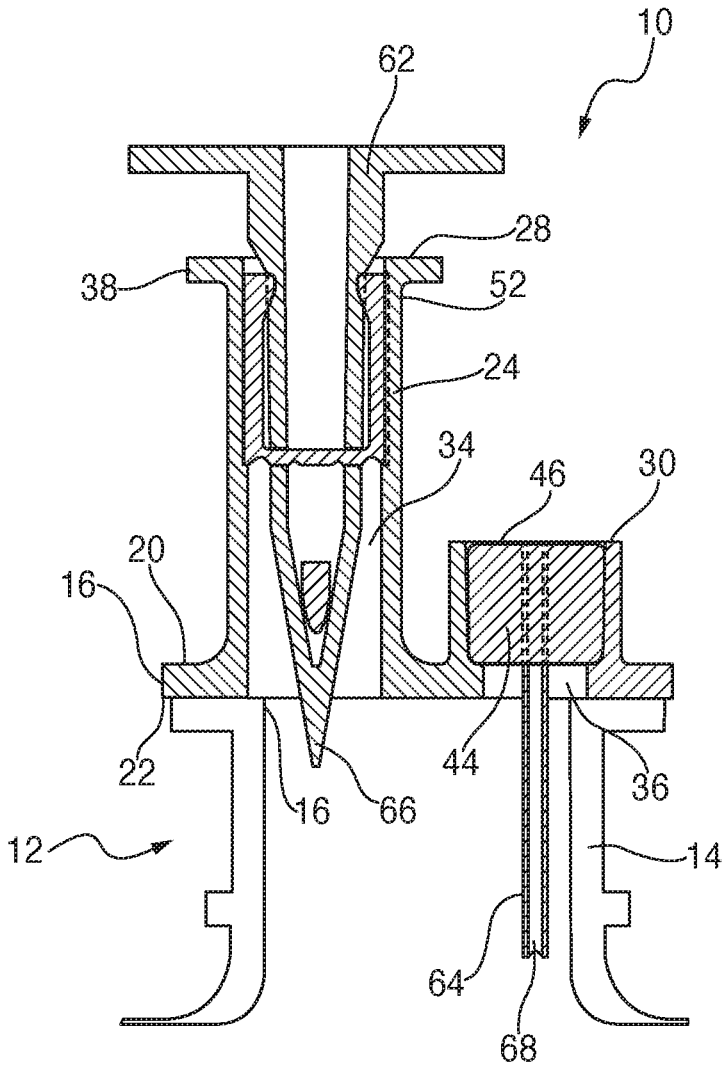
FIG. 6 is a vertical cross-section of the closure of FIG. 4 shown operationally mounted to a container.
Figure 7:
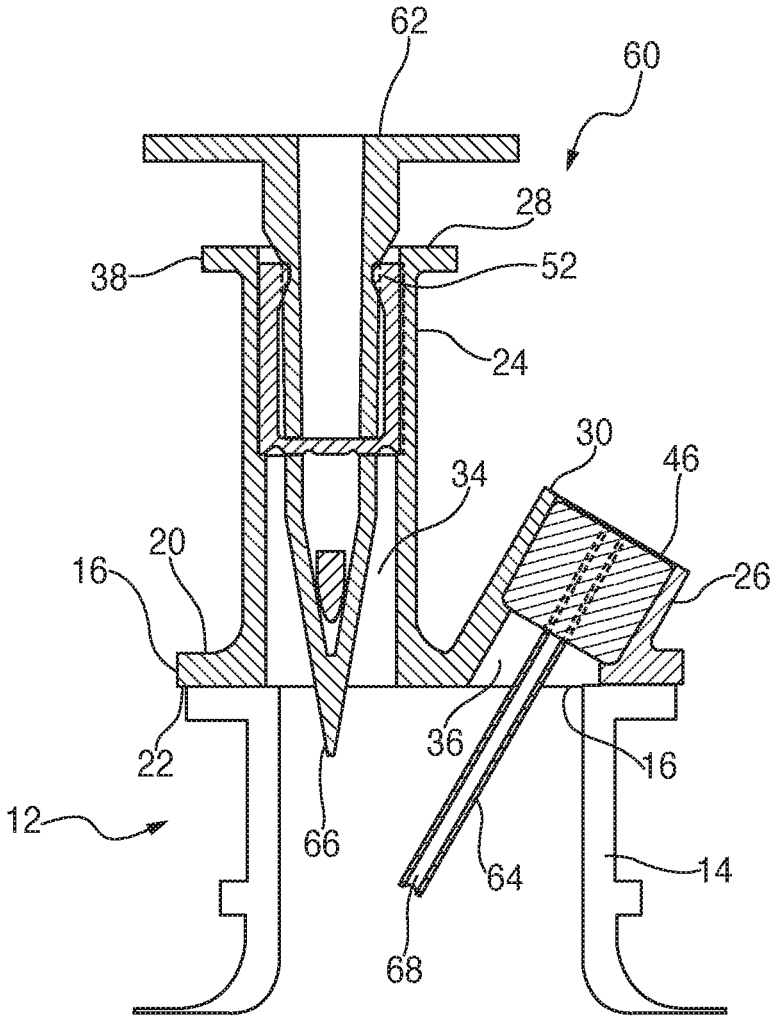
FIG. 7 is a vertical cross-section of another alternate embodiment of the closure shown operationally mounted to a container.
Figure 8:
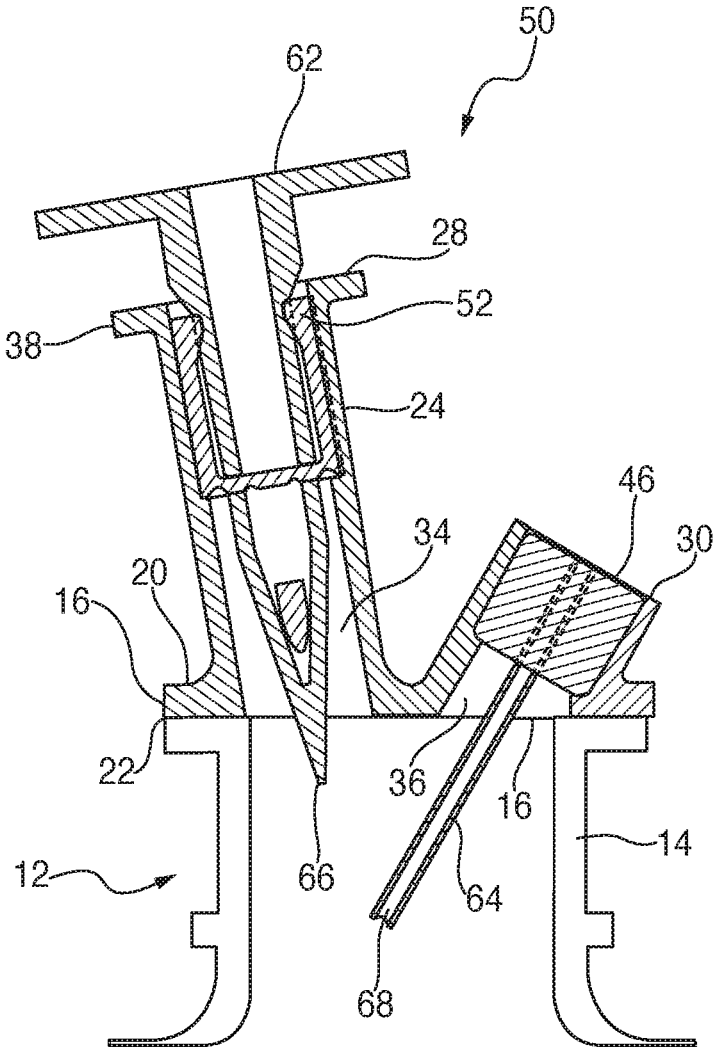
FIG. 8 is a vertical cross-section of the closure of FIG. 5 shown operationally mounted to a container.

Referring to FIGS. 6-8, vertical cross-sections are shown for variations of the closures 10, 50 and 60 (FIG. 7) in all of which a conventional administrative spike 62 is operationally and sealingly disposed in the first port 24, and a medicinal injection needle 64 is shown sealingly disposed in the second port 26. Referring briefly to FIG. 7, in the closure 60, in which features shared with the other closures are represented with identical reference numbers, the first port 24 extends generally vertically or perpendicularly from the base 16, and the second port 26 extends at an oblique angle relative to the base. It should be noted that in all of the variations of the present closure, 10, 50, 60, using at least one of the distinguishable height and the distinguishable angle of the ports 24, 26 relative to each other and/or to the base 16, respective tips 66, 68 of the spike 62 and the needle 64 are kept separated from each other, to reduce the chances of causing unwanted cross-contamination or other contact. While the present embodiments depict the spike 62 engaged in the first port 24 and the needle 64 engaged in the second port 26, it is contemplated that the arrangement is reversible. A feature of the present closures 10, 50, 60 is that this desired separation of the tips 66, 68 is maintained even within the dimensional constraints of the container neck 14, and while simultaneously providing sufficient surface area on the base 16 so that a positive attachment with the container neck is achieved, and that inadvertent contact of the spike 62 or the needle 64 with the mouth of the container is avoided.

Figure 9:
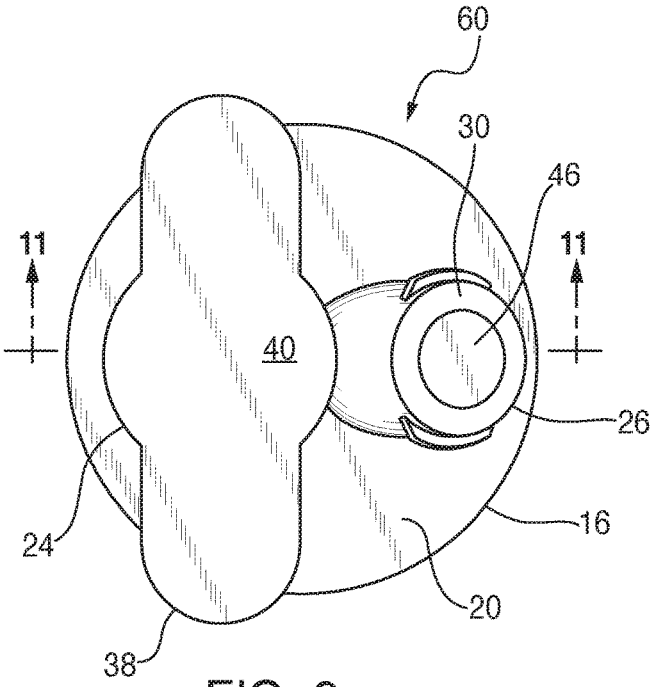
FIG. 9 is an overhead plan view of the closure of FIG. 7.
Figure 10:
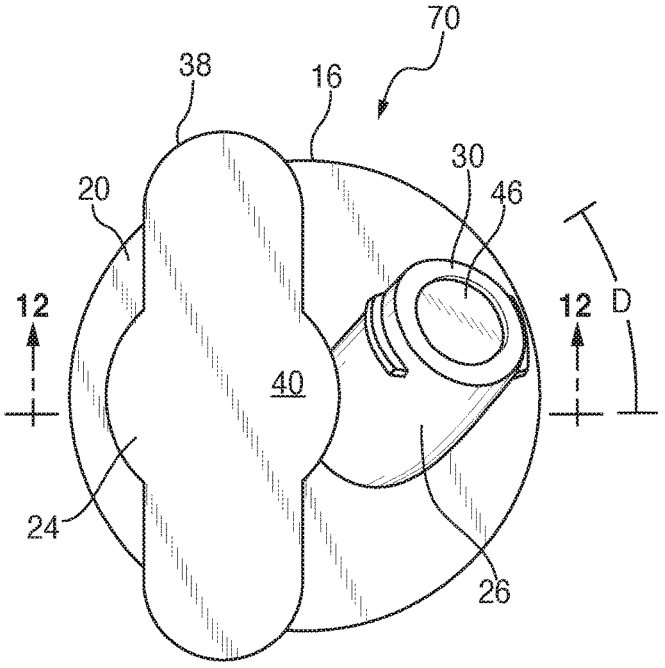
FIG. 10 is an overhead plan view of yet another alternate embodiment of the present closure.
Figure 11:
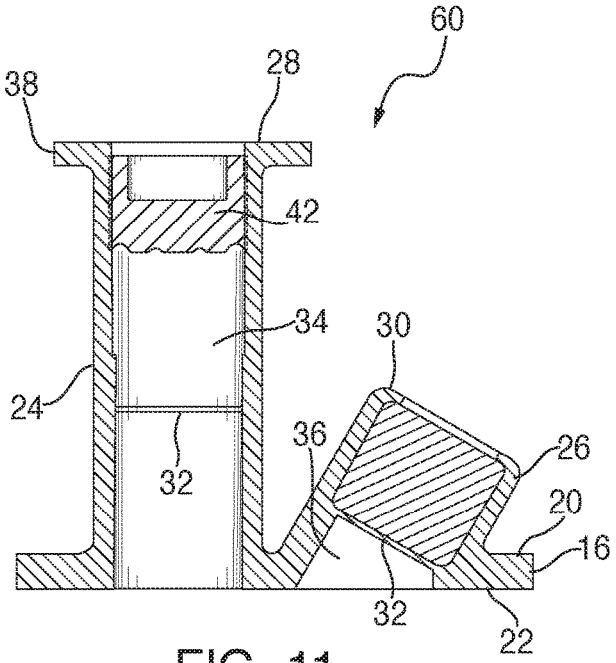
FIG. 11 is a vertical cross-section of the closure of FIG. 9 taken along the line 11-11 and in the direction indicated generally.
Figure 12:
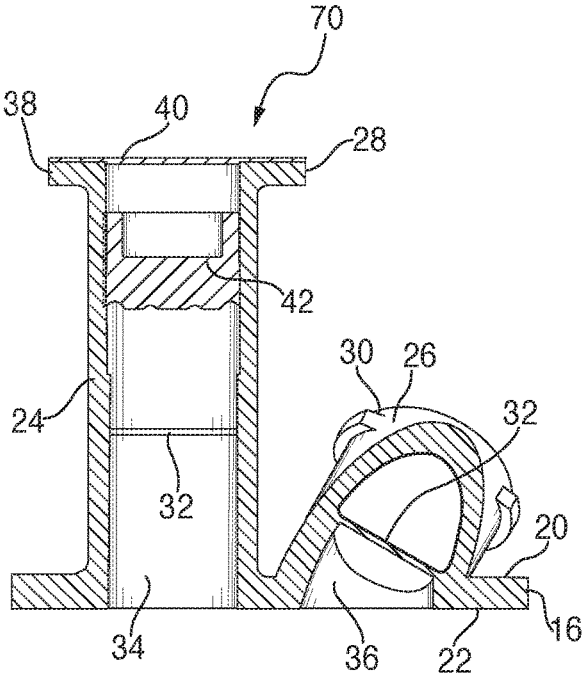
FIG. 12 is a vertical cross-section of the closure of FIG. 10 taken along the line 12-12 and in the direction indicated generally.
Figure 13:
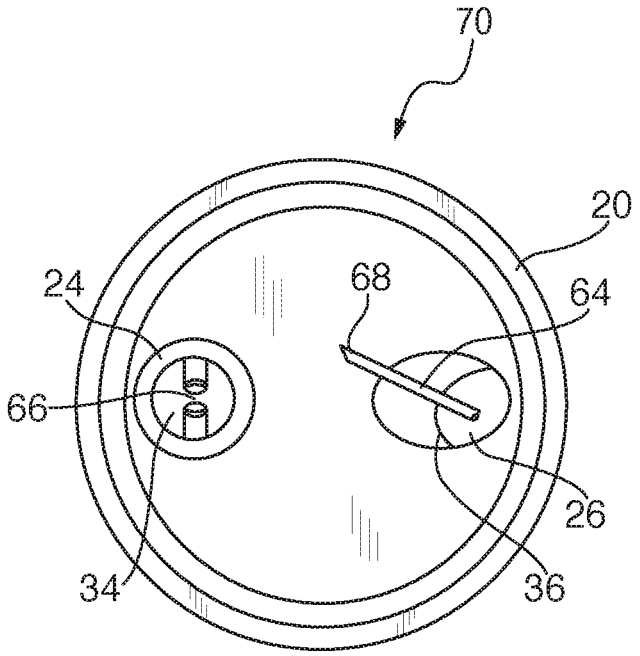
FIG. 13 is a bottom plan view of the closure of FIG. 10 showing a spike and needle inserted.

Referring now to FIGS. 9-13, another port orientation is presented. FIGS. 9 and 11 for comparison purposes depict respectively a plan and vertical cross-section view of the closure 60, also seen in FIG. 7, with the first port 24 taller than the second port 26, the first port extending generally perpendicular to the base 16, and the second port extending obliquely to the base. Another alternate embodiment of the present closure is shown in FIGS. 10 and 12, generally designated 70. Components shared with the other closure embodiments are designated with identical reference numbers. A main feature of the closure 70 is that the second port 26 is oriented at a "compound angle" relative to the first port. Vertical axes of the admin and med ports 24, 26 in FIGS. 5-9 lie in one plane and the orientation of port axes can be described by a single angle $\alpha$. The axes of the admin and med ports 24, 26 with a "compound angle" in FIGS. 10 and 12 do not lie in the same or a common plane; hence, two angles are necessary to describe the orientation of the port axes. Angle $\alpha$ describes their orientation when the axes are projected to a first plane, and angle D (FIG. 10) describes their orientation when projected to another plane normal to the first plane, As illustrated in FIG. 13, this compound angle orientation further spaces the needle tip 68 from the spike tip 66. It is contemplated that the magnitude of angles $\alpha$ and D, and the lengths of each port, may vary to suit the situation.

Referring now to FIG. 2, flats 72 on a chimney 74 of the admin port 24 provide an intuitive and ergonomic grip surface when accessing either port. The flats 72 on the admin port chimney 74 also facilitate gripping and orientation during manufacturing steps. To facilitate gripping the flats 72 while the container is lying flat on a horizontal surface such as a table, the closure 10 should be oriented to the container 12 such that the flats are parallel to the long axis (flat surface) of the container. It is contemplated that the med port 26 can be oriented at any angle(s) to the admin port 24. Angles can be selected to provide the desired distance between ports and ease of use when accessing either port when the container 12 is laying on a table or hanging from an I.V. pole.

While particular embodiments of the present port designs for a fluids container have been described herein, it will be appreciated by those skilled in the art that changes and modifications may be made thereto without departing from the invention in its broader aspects and as set forth in the following claims.

The invention claimed is:

1. A container closure for use in dispensing fluids from a container, comprising:

a base constructed and arranged for being attached to a mouth of the container;

a first port disposed on said base and in fluid communication with the mouth;

a second port disposed on said base in fluid communication with the mouth; and said first and second ports being visually differentiated from each other, wherein axes of both generally-cylindrical ports relative to said base are not parallel and do not intersect and lie in uncommon planes, and the orientation of said second port relative to the first port is described by two independent angles.

2. The closure of claim 1 wherein said first port extends vertically from said base a greater distance than said second port.

3. The closure of claim 1 wherein said first port projects from said base at a first angle relative to said base, and said second port projects at a second angle relative to said base, said first angle being distinct from said second angle, and axes of both generally-cylindrical ports forming a plane.

4. The closure of claim 3, wherein said first port is perpendicular to said base, and said second port projects at an oblique angle to said base.

5. The closure of claim 3 wherein both said first and second ports project at oblique angles to said base.

6. The closure of claim 1 wherein one of said first and second ports has a laterally extending flange.

7. The closure of claim 6 wherein said port having said flange is further provided with a removable peelable film.

8. The closure of claim 1 wherein at least one of said ports has an internal pierceable diaphragm.

9. The closure of claim 1 wherein at least one of said ports has a self-sealing sleeve disposed in an internal passage of said port.

10. The closure of claim 1 wherein at least one of said ports is configured for engagement by one of a needle and an administration spike.

11. The closure of claim 1 wherein said first port has an exterior provided with at least one flat surface.

12. A container closure for use in dispensing fluids from a container, comprising:

a base constructed and arranged for being attached to a mouth of the container;

a first port disposed on said base and in fluid communication with the mouth;

a second port disposed on said base in fluid communication with the mouth; and said first and second ports being constructed and arranged on said base to have a distinguishable height and a distinguishable angle relative each other, wherein axes of both generally-cylindrical first and second ports relative to said base are not parallel and do not intersect and lie in uncommon planes, and the orientation of said second port relative to the first port is described by two independent angles.

13. The closure of claim 12, wherein said first port is taller than said second port relative to said base, said first port extends perpendicularly to said base, and said second port extends obliquely to said base.

14. A container closure for use in dispensing fluids from a container, comprising:

a base constructed and arranged for being attached to a mouth of the container;

a first port disposed on said base and in fluid communication with the mouth;

a second port disposed on said base in fluid communication with the mouth; and said first and second ports being visually differentiated from each other, wherein said first port projects from said base at a first angle relative to said base, and said second port projects at a second angle relative to said base, said first angle being distinct from said second angle, and said first and second angles being greater than 0 degrees and less than 90 degrees, and, wherein said first port extends vertically from said base a greater distance than said second port.

* * * * *